United States Patent [19]

Wilkes et al.

[11] 4,188,217

[45] Feb. 12, 1980

[54] CATALYTIC ACTIVATION OF COBALT COMPLEX IMAGING BY COBALT SULFIDE

[75] Inventors: Glenn R. Wilkes, Webster; Albert T. Brault, Rochester, both of N.Y.

[73] Assignee: Eastman Kodak Company, Rochester, N.Y.

[21] Appl. No.: 833,787

[22] Filed: Sep. 15, 1977

Related U.S. Application Data

[62] Division of Ser. No. 595,932, Jul. 14, 1975, Pat. No. 4,061,497.

[51] Int. Cl.[2] ..... G03C 5/24

[52] U.S. Cl. ..... 430/353; 428/411; 428/539; 252/188.3 R; 430/936; 430/374

[58] Field of Search ..... 96/55, 88, 3, 77, 48 R, 96/76 R, 48 HD; 428/411, 539; 252/188.3 R

[56] References Cited

U.S. PATENT DOCUMENTS

| | | | |
|---|---|---|---|
| 1,623,499 | 4/1927 | Sheppard et al. | 96/88 |
| 1,880,449 | 10/1932 | Hickman et al. | 96/88 |
| 1,962,307 | 6/1934 | Hickman et al. | 96/88 |
| 2,084,420 | 6/1937 | Weyde | 96/66 R |
| 2,673,800 | 3/1954 | Meeussen et al. | 96/3 |
| 2,698,237 | 12/1954 | Land | 96/76 R |
| 3,046,129 | 7/1962 | Graham et al. | 96/100 |
| 3,062,645 | 11/1962 | Carroll | 96/100 |
| 3,862,842 | 1/1975 | Bissonette | 96/55 |

OTHER PUBLICATIONS

Research Disclosure, vol. 109, Publication 10911, May 1973.

Research Disclosure, vol. 130, Publication 13023, Feb. 1975.

*Primary Examiner*—Won H. Louie, Jr.

*Attorney, Agent, or Firm*—Dana M. Schmidt

[57] ABSTRACT

An imaging system and process wherein an element comprising a cobalt complex-developer redox system is catalyzed by cobalt sulfide. The cobalt sulfide can be imagewise produced by exposing a photoreducible cobalt complex in the presence of a thioamide, or it can be uniformly distributed and either masked in an imagewise fashion, or reacted with imagewise distributed color developing agent.

4 Claims, 5 Drawing Figures

CATALYTIC ACTIVATION OF COBALT COMPLEX IMAGING BY COBALT SULFIDE

This is a division of application Ser. No. 595,932, filed July 14, 1975 now U.S. Pat. No. 4,061,497.

BACKGROUND OF THE INVENTION (1) Field of the Invention

This invention relates to an imaging process and element which rely upon a redox reaction between a cobalt(III)complex and a color developing agent, wherein the oxidized developing agent imagewise combines with a color coupler to form a dye image. A catalyst is provided for initiating the reaction.

(2) State of the Prior Art

The use of redox reactions between cobalt(III)complexes an color developing agents, so that the oxidized developing agent combines with a dye coupler, is shown for example in *Research Disclosure,* Vol. 109, May, 1973, Publication No. 10911. In that teaching, the catalyst is silver. Although such systems have proven to be very satisfactory, they rely upon an initial silver image, and therefore upon a silver salt emulsion as the photographic element. The rapid increase in the cost of silver has necessitated the search for a less expensive substitute. A cheaper catalyst which performs as well as or better than silver is therefore a much sought-after improvement.

Other imaging systems based upon the reduction of a cobalt(III)complex have been introduced. Examples are shown in copending U.S. application Ser. No. 461,057, filed Apr. 15, 1974 by Anthony Adin and James C. Fleming, entitled "Transition Metal Photoreduction Systems and Processes", now abandoned and Ser. No. 461,171, filed on Apr. 15, 1974 by Albert T. Brault et al, entitled "Spectral Sensitization of Transition Metal Complexes", commonly owned with the instant application, now abandoned. The imaging mechanism in those cases relies upon the formation of cobalt(II) and the decomposition of the ligands of the complex to form ammonia. Either of these reaction products in turn can be utilized to initiate an image, and a coupler may be incorporated to form a dye. For example, the aforesaid application Ser. No. 461,171 discloses thioamide functional groups, such as thiourea and thioacetamide which are incorporated along with the cobalt(III)complex, so that the reduced cobalt(II) combines with sulfide ions to form cobalt sulfide. The cobalt sulfide is either the final imaging means, or it may be secondary with the decomposed ligands forming the image in a separate, adjacent layer comprising a conventional diazonium salt, the coupler being in the adjacent layer. But in both these applications, there is no use of the cobalt sulfide image to catalyze a redox reaction.

Other patents which disclose in general the production of cobalt sulfide images or other metallic sulfide images are U.S. Pat. Nos. 1,880,449, issued to K. Hickman et al, and 2,084,420, issued to E. I. Weyde. These however do not teach the use of these images as catalysts.

Disclosures typical of the use, in an image-forming layer, of minute amounts of sulfide ion sources for sensitizing purposes and not as a primary imaging agent include the teachings of U.S. Pat. No. 1,623,499 issued to Shepard.

OBJECTS OF THE INVENTION

In view of the foregoing, it is an object of the invention to provide a redox imaging system utilizing cobalt (III) complexes and color developing agents, which is activated by cobalt sulfide as a catalyst.

Other objects and advantages will become apparent upon reference to the following Summary and Description of the Preferred Embodiments, when read in light of the attached drawings.

Figure 1:
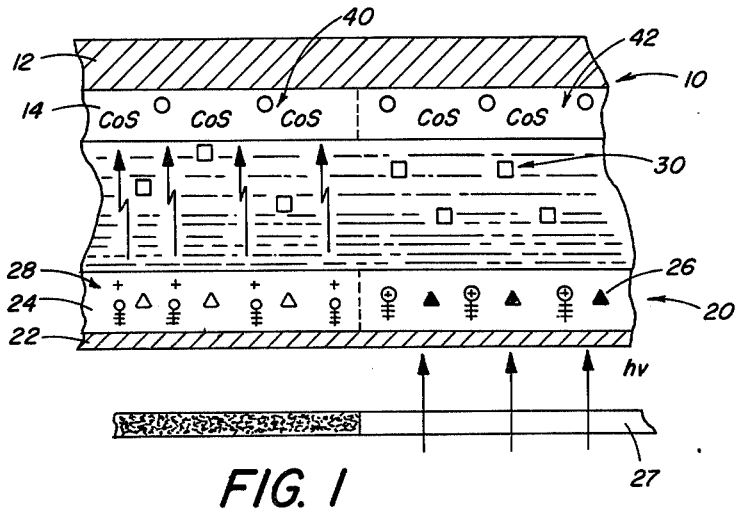
FIG. 1 is a partially schematic elevational view in section of an image-recording element constructed in accordance with the invention.

For ease of illustration the thicknesses of the layers have been exaggerated and are not drawn to scale.

SUMMARY OF THE INVENTION

The invention concerns an imaging element and process wherein a redox developer is used to develop the exposed elements, and a non-silver catalyst is provided by the imagewise exposed element. More specifically, there is provided an image-recording element comprising a support, and at least one image-providing layer on the support, the layer comprising (a) either CoS, or means for forming CoS in said layer, said means including a source of sulfide ions in an amount of at least about $2.5 \times 10^{-5}$ moles/dm$^2$; and (b) a color coupler capable of forming a dye by reaction with an oxidized color developing agent. The cobalt sulfide can be imagewise formed upon exposure of this element, or uniformly distributed, the process preferably comprising the steps of reacting in imagewise distributed portions of the layer, a reducible cobalt(III)complex and a color developing agent in the presence of the cobalt sulfide and a color coupler, whereby the developing agent is oxidized, and the oxidized developing agent reacts with the coupler to form a dye image.

DESCRIPTION OF THE PREFERRED EMBODIMENTS

The image-recording element of the present invention comprises a support and at least one image-providing layer coated onto the support, and relies upon the discovery that CoS is a catalyst for the redox reaction between cobalt(III)complex and a color developing agent.

Any conventional photographic support can be used in the practice of this invention. Typical supports include transparent supports, such as film supports and glass supports as well as opaque supports, such as metal and photographic paper supports. The support can be either rigid or flexible. The most common photographic supports for most applications are paper or film supports, such as poly(ethylene terephthalate) film. Suitable exemplary supports are disclosed in *Product Licensing Index,* Vol. 92, December 1971, Publication 9232, page 108. The support can incorporate one or more subbing layers for the purpose of altering its surface properties so as to enhance the adherency of hydrophilic radiation-sensitive coatings to the support. A typical example of a subbing material is the terpolymer of vinylidene chloride, acrylonitrile, and vinyl chloride.

The image-forming layer coated onto the support preferably comprises a color coupler capable of combining with an oxidized color developing agent to form an image, and either cobalt sulfide uniformly distributed throughout, or means for forming cobalt sulfide in an imagewise distribution. Generally a binder or vehicle for the aforedescribed components is desirable, and it can be selected from conventional examples such as gelatin and others disclosed in *Product Licensing Index,* Vol. 92, December 1971, Publication 9232, page 108. The cobalt sulfide of this layer catalyzes a redox reaction between a cobalt(III)complex and a color developing agent, both of which can be introduced via a solution in contact with the image-forming layer.

Any conventional cobalt(III)complex used in redox reactions with developing agents, for example, can be used. Typical complexes are disclosed for example in Bissonette U.S. Pat. Nos. 3,834,907 (issued Sept. 10, 1974); 3,862,842 (issued Jan. 28, 1975); 3,856,524 (issued Dec. 24, 1974); and 3,826,652 (issued July 30, 1974); in J. S. Dunn U.S. Pat. No. 3,822,129 (issued July 2, 1974); in R. G. Mowrey et al U.S. Pat. No. 3,841,873 (issued Oct. 15, 1974); and in W. B. Travis U.S. Pat. No. 3,765,891 (issued Oct. 16, 1973). The disclosure of these patents are here incorporated by reference. Preferred complexes are "inert" cobalt(III)complexes, wherein "inert" means a complex of the cobalt ion with a ligand such as a Lewis base which, when a test sample thereof is dissolved at 0.1 molar concentration at 20° C. in an inert solvent solution also containing 0.1 molar concentration of a tagged ligand of the same species which is uncoordinated, exhibits essentially no exchange of uncoordinated and coordinated ligands for at least 1 minute, and preferably for at least several hours, such as up to 5 hours or more. This test is advantageously conducted under the pH conditions which will be utilized in the practice of the invention. Many cobalt complexes useful in this invention show essentially no exchange of uncoordinated and coordinated ligands for several days. The definition of "inert" metal complexes and the method of measuring ligand exchange using radioactive isotopes to tag ligands are well-known in the art; see, for example, Taube, *Chem. Rev.,* Vol. 50, p. 69 (1952) and Basolo and Pearson, *Mechanisms of Inorganic Reactions, A Study of Metal Complexes and Solutions,* 2nd Edition, 1967, published by John Wiley and Sons, p. 141.

Such an inert cobalt(III)complex is readily reduced in the presence of a sulfide ion source to the cobalt(II) form which is reactive with the sulfide. Typical useful ligands for the complex include the halides, e.g., chloride, bromide or fluoride, nitrite, water, amino, etc., as well as such other common ligands as nitrate, azide, thiocyanate, isothiocyanate, carbonate, sulfite, sulfate, perchlorate and acetate groups. Those cobalt complexes having coordination numbers of 6 and known as octahedral complexes are preferred; and the cobalt hexammine salts are especially useful in the successful practice of this invention. Other desirable cobalt ammine complexes include $[Co(NH_3)_5H_2O]X$; $[Co(NH_3)_5CO_3]X$; $[Co(NH_3)_5Cl]X$ and $[Co(NH_3)_4CO_3]X$, wherein X represents one or more anions determined by the charge neutralization rule. Another suitable complex includes that represented by the formula $[Co(NH_3)_6]_2(C_2O_4)_3$.

In one form the complex can be a neutral compound free of anions or cations. If anions are necessary for charge balance, especially useful anions such as halides (e.g., chloride, bromide, fluoride, etc.), sulfite, sulfate, alkyl or aryl sulfonates, nitrate, nitrite, perchlorate, carboxylates (e.g., halocarboxylates, acetate, hexanoate, etc.), hexafluorophosphate, tetrafluoroborate, as well as other, similar anions. The most useful inert cobalt(III)-complexes are those which, in accordance with the charge neutralization rule, incorporate anions having a net negative charge of 3. Exemplary useful examples of inert cobalt(III) complexes are disclosed and claimed in commonly assigned U.S. Application Ser. No. 461,057 filed Apr. 15, 1974 by Anthony Adin et al, entitled "Transition Metal Photoreduction Systems and Processes", and include, for example, hexa-amine cobalt(III) acetate; hexa-ammine cobalt(III) thiocyanate; bromopenta-ammine cobalt(III) bromide; aquopenta-ammine cobalt(III) nitrite; trinitrotris-ammine cobalt(III); tris(1,3-propanediamine)-cobalt(III)trifluoroacetate; and μ-superoxodeca-ammine dicobalt(III)perchlorate. A longer list of these and other complexes is published in *Research Disclosure,* Vol. 126, Oct. 1974, Publication No. 12617, Paragraph III(C), and is incorporated herein by reference.

UNIFORMLY DISTRIBUTED CoS

By "uniform distribution", it is meant a distribution other than in an imagewise manner. When a uniform distribution of CoS in the image-forming layer is used, a separate radiation-sensitive element preferably is exposed and contacted with the image-forming layer in a manner which will either permit diffusion to the image-forming layer of imagewise distributed color developing agent, or which will imagewise mask the cobalt sulfide. Thus, the radiation-sensitive element can comprise a layer of silver halide, an excess of ballasted color coupler, and an incorporated color developing agent such as p-phenylenediamine. After image-wise exposure, the radiation-sensitive element is coated with an alkaline solution and contacted with the image-providing layer. Under these conditions, the latent silver image in the exposed areas causes development of a dye image due to the redox reaction between the silver halide and the color developing agent, as is well-known and in unexposed areas, the non-oxidized color developing agent is free to diffuse to the image-providing layer where it reacts with a color coupler that is pre-incorporated into the image-providing layer.

FIG. 1 illustrates a typical example of the aforedescribed formation of imagewise distributed color developing agent in the image-forming layer. Image-recording element or receiver sheet 10 comprises a support 12 and an image-forming layer 14, in which there is uniformly distributed a binder, CoS, and a color-forming coupler designated by the circles. Radiation-sensitive element 20 comprises a preferably transparent support 22 and a layer 24 of a conventional binder such as gelatin, in which there is distributed in a conventional manner, suitable silver halide, designated by the triangles, color developing agent designated by the + signs, and ballasted color coupler shown by the symbol ⚥. As is conventional, the silver halide can be spectrally sensitized in the manner discussed in the aforesaid *Product Licensing Index* publication, Paragraph XV. Typical examples of such ballasted color couplers are described in the patents listed in the aforesaid *Product Licensing Index* publication, Paragraph XXII.

As an alternate to a transparent support 22, such as a film, the support may be opaque such as paper, so that conventional black and white print paper can be used. In that case, exposure obviously is achieved through layer 24 before the image receiver sheet is associated with element 20.

Image formation is caused in sheet 10 by conventional imagewise transfer to that element of developing agent in the manner disclosed, for example, in Land U.S. Pat. No. 2,661,293. That is, a portion 26 of element 20 is exposed to activating radiation through a mask 27 causing latent silver images to form. No exposure occurs in portion 28. When an alkaline solution 30, such as a water solution of cobalt(III)complex, shown by the rectangles, adjusted to a pH of at least 8.0 with dilute NaOH, is added and image-recording sheet 10 is placed in contact with the element 20, the alkaline solution 30 diffuses into both element 20 and sheet 10. The thickness of the solution in FIG. 1 is exaggerated for clarity, as in actuality the layers 14 and 24 are generally in contact. Conventional development of silver and the reaction between the thus oxidized color developing agent and ballasted coupler takes place in portion 26, as shown by the symbol ⚥. Thus in this portion, the developing agent is rendered immobile. Simultaneously, element 10 acts as a receiver sheet in that the non-oxidized developing agent is free to diffuse or transfer from portion 28 of element 20, as shown by the wavy arrows, directly into only portion 40 of layer 14, thus becoming imagewise distributed. As the cobalt(III)complex diffuses into portion 40, the CoS catalyzes a redox reaction between the imagewise distributed color developing agent and the complex, so that the oxidized developing agent is free, in portion 40, to combine with the coupler to form an image. The reaction is similar to that described in *Research Disclosure,* Vol. 109, May 1973, Publication 10911, except that the CoS is the catalyst for the redox reaction. The color of the final image will, of course, depend on the coupler chosen for incorporation in the image-providing layer.

The coupler in layer 14 preferably is a color coupler capable of reacting with an oxidized color developing agent to form a dye image. The term "color coupler" includes any compound which reacts (or couples) with the oxidation products of primary aromatic amine developing agent on photographic development to form or release an image dye in a hydrophilic colloid binder (e.g., gelatin) of the type useful for photographic silver halide. The couplers preferably are selected to form nondiffusible dyes. Typical preferred color couplers include cyan, magenta and yellow dye-forming couplers, such as are disclosed in U.S. Pat. Nos. 2,895,826; 2,875,057; 2,407,210; 3,260,506; 2,772,162; 2,895,826; 2,474,293; 2,369,489; 2,600,788; 2,908,073; and 3,519,429. Thus, representative couplers include phenols, naphthols, pyrazolones, and open-chain ketomethylenes such as $\beta$-diketones and $\beta$-ketoamides. Specific useful couplers include 5-[$\alpha$-(2,4-di-tert-amylphenoxy)hexamido]-2-heptafluorobutyramidophenyl and 2,4-dichloro-5-p-toluenesulfonamido-1-naphthol, as well as those described in Graham et al U.S. Pat. No. 3,046,129, issued Jan. 24, 1962, Column 15, line 45 through Column 18, line 51.

Such color couplers can be dispersed in any convenient manner, such as by using the solvents and the techniques described in U.S. Pat. Nos. 2,322,027 by Jelley et al, issued June 15, 1943, or 2,801,171 by Fierke et al, issued July 30, 1957. When coupler solvents are employed, the most useful weight ratios of color coupler to coupler solvent range from about 1:3 to 1:0.1. The useful couplers include Fischer-type incorporated couplers such as those described in Fischer U.S. Pat. No. 1,055,155, issued Mar. 4, 1913, and particularly nondiffusible Fischer-type couplers containing branched carbon chains, e.g., those referred to in the references cited in Frohlich et al, U.S. Pat. No. 2,376,679, issued May 22, 1945, Column 2, lines 50–60. Particularly useful in the practice of this invention are the nondiffusible color couplers to form nondiffusible dyes. Such couplers are useful as the ballasted couplers in layer 24.

The color developing agent represented by the "+" symbols in FIG. 1 is any suitable oxidizable developing agent, such as those taught in U.S. Pat. Nos. 2,108,243; 2,193,015; 2,304,953; 3,656,950; and 3,658,525. Thus, representative developing agents include the primary aromatic amines such as phenylene-diamines and p-aminophenols, preferably in the form of an acid salt to stabilize the agent during storage. Other useful developers and techniques are set forth in *Product Licensing Index*, Vol. 92, December 1971, Publication 9232, p. 110, Paragraph XXIII.

Alternatively, it has been found that unexposed silver halide can be solubilized and the silver complex can be imagewise transferred by conventional silver salt diffusion processes such as are disclosed in Land U.S. Pat. No. 2,543,181, from a photosensitive sheet to the image forming layer of the receiver sheet containing a uniform distribution of CoS. The effect is to imagewise mask or destroy CoS by reacting the complexed silver with the CoS to form $Ag_2S$. The remaining, unmasked CoS is thus imagewise distributed in the image-forming layer to act as a catalyst for the redox reaction between the cobalt(III)complex and the color developer. It will be appreciated that the same imaging element 10 and exposure sheet 20 of FIG. 1 can be utilized, as well as the development process for layers 24 and 14 described above except that solution 30 is modified, by adding a silver salt solubilizing complexing agent, and by eliminating the cobalt(III)complex. Layer 24 can also be modified by eliminating the dye-forming coupler, so as to comprise instead a conventional black and white silver halide emulsion. That is, in the manner disclosed in the aforesaid Land U.S. Pat. No. 2,543,181, the exposed silver halide grains of portion 26 of layer 24 are developed by a conventional developing agent wich diffuses into it from solution 30. That solution, or a subsequent bath, contains a conventional silver halide solvent or complexing agent, such as sodium sulfite or thiosulfate, which solubilizes or complexes the undeveloped silver halide in portion 28. The solubilized silver then diffuses or transfers only to portion 40 of layer 14 which is in contact with layer 24. Undesired physical development of the silver at sites formed by the CoS can be prevented by presoaking layer 14 in an acidic solution.

Image formation occurs in element 10 by reason of solutions of cobalt(III)complex washed into element 10 subsequent to solution 30, which lacks the cobalt(III)complex in this embodiment. The subsequent solution can also include the necessary color developing agent, preferably at a strongly alkaline pH, or the color developing agent can be uniformly pre-incorporated into layer 14, not shown. Because the CoS has been converted to $Ag_2S$ in portion 40, portion 42 will more readily catalyze the redox reaction between the cobalt(III)complex and the color developer, leading to image dye formation in portion 42 of the oxidized developing agent with the coupler of layer 14.

Yet another embodiment featuring the catalysis of the redox reaction by the cobalt sulfide of element 10 is one in which an oleophilic photoresist layer, not shown, is coated over layer 14, and imagewise portions of the photoresist are etched away by conventional methods, thus exposing only imagewise portions of the cobalt sulfide layer 14. When solution 30, containing the cobalt(III)complex and the color developing agent of the types described above, is distributed over the photoresist and the layer 14, the complex and the developing agent can diffuse into layer 14 only at the uncoated portions thereof. It is at these imagewise distributed portions that the redox reaction between the developing agent and the complex takes place, as catalyzed by the CoS.

MEANS FOR IMAGEWISE FORMING CoS

Figure 2A:
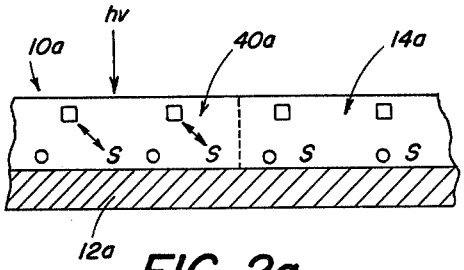
FIGS. 2*a,* 2*b,* 3*a* and 3*b* are views similar to FIG. 1, but illustrating other embodiments of the invention.
Figure 2B:
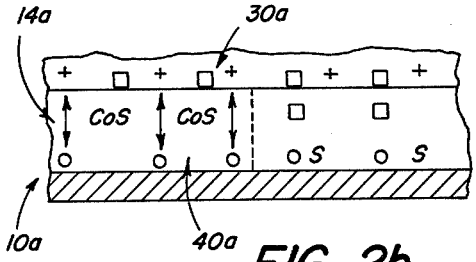

Turning now to FIGS. 2*a* and 2*b*, in accordance with yet another aspect of the invention, the CoS can be imagewise generated or formed in situ in the image-recording layer. Parts similar to those previously described bear the same reference numeral to which the distinguishing suffix "a" has been added. Thus, image-recording element 10*a*, FIG. 2*a*, comprises a support 12*a*, which can be identical to that disclosed in connection with FIG. 1, and an image-providing layer 14*a* comprising a binder, a coupler such as that disclosed in connection with FIG. 1, and a means for forming CoS. Such means, in one form, includes a photoreactible mixture of cobalt(III)-complex, designated by rectangles, and a source of sulfide ions designated by the letter "S". The complex can be exactly as described above concerning the embodiment of FIG. 1. A particularly useful source of such sulfide ions is thioamides having the functional group

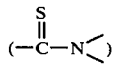

and which is capable of reacting with cobalt in the plus 2 valence state, hereinafter, cobalt(II). The thioamide compound chosen sould be chemically compatible with the other components of the image-forming layer prior to exposure and heating. Among the useful thioamide compounds are thiourea and thioacetamide as well as substituted and/or cyclized derivatives thereof. Alkyl, aryl, alkaryl and aralkyl substituted thiourea and thioacetamides are particularly contemplated. The aryl substituents and substituent moieties can include groups such as phenyl, naphthyl, anthryl, etc. The alkyl substituents and substituent moieties can include branched and straight chain acyclic and cyclic alkyl groups having from 1 to 20 carbon atoms, preferably from 1 to 6 carbon atoms. To increase the image densities obtainable with thioamide compounds it has been found useful to increase their maximum solubilities within the image-providing layer. This can be accomplished by employing combinations of thioamides or thioamides in combination with other solubilizing compounds. For example, thioacetamide and sulfamide are good solubilizing agents for thiourea in gelatin. It has been discovered that the use of a transparent overlayer incorporating one or more thioamide compounds will increase the optical density of images obtained. The overlayer offers the advantage of allowing greater concentrates of the thioamides to be employed. It has also been observed that superior results are obtained using thioamides to produce images if the radiation-sensitive layer is heated concurrently with exposure.

Exemplary thioamide compounds useful or contemplated as being useful in the practice of this invention are listed in the following Table I:

TABLE I

Exemplary Thioamides for Producing Cobalt Sulfide Images

TA-1 N,N-dimethylthioformamide
TA-2 thioacetamide
TA-3 thiobutanamide
TA-4 thiohexanamide
TA-5 2-phenylthioacetamide
TA-6 N,N-dimethylthioacetamide
TA-7 N,N-dihexylthioacetamide
TA-8 4-ethyl-3-thiosemicarbazide
TA-9 thiorea
TA-10 N-meythylthiourea
TA-11 N,N'-diphenylthiourea
TA-12 -ethanedithioamide
TA-13 propylene thiourea
TA-14 1-phenyl-2-thiourea
TA-15 diallylthourea
TA-16 3-allyl-1,1-diethyl-2-thiourea
TA-17 thiobenzamide
TA-18 thiobenzanilide
TA-19 thiocarbanilide
TA-20 thioacetanilide
TA-21 dithiobourea
TA-22 dithiooxamide
TA-23 ethyldithiocarbamic acid
TA-24 N,N'-dimethyldithiooxamide
TA-25 thiocarbohydrazide
TA-26 1,5-diphenyl-3-thiocarbohydrazide The amount of sulfide source must be at least that which will form an adequate amount of CoS catalyst, and it has been found that such minimum amount is preferably about $2.5\times10^{-5}$ moles/dm$^2$.

Because of the tendency of cobalt(III)complexes to be insensitive to radiation having wavelengths longer than about 300 nanometers, still another ingredient that can be included in the element 10*a* is a photoactivator (not shown) especially responsive to such radiation. As used herein, "photoactivator" means a spectral sensitizer or a photoreductant which renders the complex imagewise responsive to longer wavelength radiation. Thus, suitable photoactivators include spectral sensitizers such as those disclosed and claimed in commonly assigned U.S. Application Ser. No. 461,171, filed Apr. 15, 1974, entitled "Spectral Sensitization of Transition Metal Complexes", by Albert T. Brault et al. Particularly useful examples of spectral sensitizers for use in the practice of this invention are those having an anodic polarographic half-wave potential (also referred to as a ground state oxidation potential) which is less than one volt. It is further preferred that the spectral sensitizers be chosen so that the sum of the cathodic polarographic half-wave potential (also referred to as a ground state reduction potential) and the anodic polarographic half-wave potential is more negative than −0.50 volt.

As used herein, polarographic measurements are made in accordance with the following procedure. Cathodic polarographic half-wave values are obtained against an aqueous silver-silver chloride reference electrode for the electrochemical reduction of the test compound using controlled-potential polarographic techniques. A $1\times10^{-4}$ M methanol solution of the test compound is prepared. The solvent is 100 percent methanol, if the compound is soluble therein. In some instances, it is necessary to use mixtures of methanol and another solvent, e.g., water, acetone, dimethylformamide, etc., to prepare the $1\times10^{-4}$ M solution of the test compound. There is present in the test solution, as supporting electrolyte, 0.1 M lithium chloride. Only the most positive (least negative) half-wave potential value observed is considered, and it is designated herein as the ground state reduction potential or simply the reduction potential. Anodic half-wave values are determined against an aqueous silver-silver chloride reference electrode for the electrochemical oxidation of the tested compounds at a pyrolytic graphite electrode, and are obtained by controlled-potential voltammetry using solutions identical to those used to determine the cathodic polarographic values. Only the most negative (least positive) half-wave potential observed is utilized, and it is designated herein as the ground state oxidation potential. In both measurements, the reference electrode (aqueous silver-silver chloride) is maintained at 20° C. Signs are given according to the recommendation if IUPAC at the Stockholm Convention, 1953. The well known general principles of polarographic measurements are used. See Kolthoff and Ligane, "Polarography" second edition, Interscience Publishers, New York (1952). The principles of controlled-potential electrochemical instrumentation which allows precise measurements in solvents of low conductivity is described by Kelley, Jones and Fisher, *Anal. Chem.*, 31, 1475 (1959). The theory of potential sweep voltammetry such as that employed in obtaining the anodic determinations is described by Delahay, "New Instrumental Methods in Electrochemistry" Interscience Publishers, New York (1954) and Nicholson and Shain, *Anal. Chem.*, 36, 706 (1964). Information concerning the utility and characteristics of the pyrolytic graphite electrode is described by Chuang, Fried and Elving, *Anal. Chem.*, 36, (1964). It should be noted that the spectral sensitizers and cobalt(III)complexes operable in this invention include those which contain oxidizable ions, such as iodide. For example, many tested compounds which are iodide salts are useful herein. However, the polarographic measurements referred to above cannot be determined in the presence of oxidixable ions. Therefore, such compounds are converted, just for purposes of making polarographic determinations, to an anion such as chloride or p-toluenesulfonate, which do not interfere in making accurate polarographic measurements. Hence, compounds containing oxidizable ions are included within the scope of the useful compounds defined herein and in the claims.

The spectral sensitizers useful in the practice of this invention can be chosen from among those classes of spectral sensitizers known to sensitize negative silver halide emulsions. The spectral sensitizers can take the form of sensitizing dyes, such as acridines, anthrones, azo dyes, azomethanes, cyanines, merocyanines, styryl and styryl base dyes, polycyclic hydrocarbon dyes, ketone dyes, nitro dyes, oxonols (including hemioxonols), sulfur dyes, triphenylmethane dyes, xanthene dyes, etc.

Cyanine dyes have been found to be particularly advantageous. The term "cyanine dye", as used herein, is to be construed broadly as inclusive of simple cyanines, carbocyanines, dicarbocyanines, tricarbocyanines, rhodacyanines, etc. Cyanine dyes can contain such basic nuclei as the thiazolines, oxazolines, pyrrolines, pyridines, oxazoles, thiazoles, selenazoles and imidazoles. Such nuclei can contain alkyl, alkylene, hydroxyalkyl, sulfoalkyl, carboxyalkyl, aminoalkyl and enamine groups and can be fused to carbocyclic or heterocyclic ring systems either unsubstituted or substituted with halogen, phenyl, alkyl, haloalkyl, cyano, or alkoxy groups. The cyanine dyes can be symmetrical or unsymmetrical and can contain alkyl, phenyl, enamine or heterocyclic substituents on the methine or polymethine chain. Cyanine dyes include complex(tri- or tetra-nuclear) cyanines.

Merocyanine dyes can be employed which are generally comparable to the cyanine dyes discussed above. The merocyanine dyes can contain the basic nuclei noted above as well as acid nuclei such as thiohydantoins, rhodanines, oxazolidenediones, thiazolidenediones, barbituric acids, thiazolineones, and malononitriles. These acid nuclei can be substituted with alkyl, alkylene, phenyl, carboxyalkyl, sulfoalkyl, hydroxyalkyl, alkoxyalkyl, alkylamino groups or heterocyclic nuclei.

As examples of other useful spectral sensitizers conventional optical brighteners which otherwise satisfy the criteria of this invention can be employed to spectrally sensitize cobalt(III) complexes. These are particularly useful as they can be incorporated into the fibers of the support, if the support is a paper sheet. Exemplary categories of known optical brighteners useful in sensitizing inert cobalt(III)complexes include stilbenes, triazenes, naphthylene sulfonates, oxazoles and coumarins. Particularly preferred optical brighteners useful in the practice of this invention are bistriazinyl-aminostilbnes, particularly bis-triazinylaminostilbene disulfonates. Exemplary preferred sensitizers of this type are disclosed in U.S. Pat. Nos. 2,875,058; 3,012,971 and 3,025,242.

It has been observed that a further example of a useful spectral sensitizer for cobalt(III)complexes is hematoporphyrin. For example, hexa-amine cobalt(III) can be selectively spectrally sensitized to the red portion of the visible spectrum employing hematoporphyrin as a spectral sensitizer.

Exemplary spectral sensitizers preferred for use in the practice of this invention are described and listed in *Research Disclosure*, Vol. 130, February 1975, Publication No. 13023, Paragraphs III(A) through (L), expressly incorporated herein by reference.

Also suitable are the photoreductants disclosed and claimed in the aforesaid application by Adin et al, Ser. No. 461,047. As employed herein, the term "photoreductant" designates a material capable of molecular photolysis or photo-induced rearrangement to generate a reducing agent, which forms a redox couple with the cobalt(III)complex. The reducing agent spontaneously or with the application of heat reduces the cobalt(III)-complex. The classes of photoreductants pertinent in general include quinones, disulfides, diazoanthrones, and phenazinium salts. In addition, diazophenanthrones, carbazides, diazosulfonates, diazonium salts and aromatic azides are useful.

Disulfide photoreductants are preferably aromatic disulfides containing one or two aromatic groups attached to the sulfur atoms. The nonaromatic group can take a variety of forms, but is preferably a hydrocarbon group, such as an alkyl group having from 1 to 20 (preferably 1 to 6) carbon atoms.

The quinones which are useful as photoreductants include ortho- and para-benzoquinones and ortho- and para-naphthoquinones, phenanthrenequinones and anthraquinones. The quinones may be unsubstituted or incorporate any substituent or combination of substituents that do not interfere with the conversion of the quinone to the corresponding reducing agent. A variety of such substituents are known to the art.

A preferred class of photoreductants are internal hydrogen source quinones; that is, quinones incorporating labile hydrogen atoms. These quinones are more easily photoreduced than quinones which do not incorporate labile hydrogen atoms. Even when quinones lacking labile hydrogen atoms are employed in combination with an external source of hydrogen atoms while incorporated hydrogen source quinones are similarly employed without external hydrogen source compounds, the internal hydrogen source quinones continue to exhibit greater ease of photoreduction. When internal hydrogen source quinones are employed with external hydrogen source compounds their ease of photoreduction can generally be further improved.

Particularly preferred internal hydrogen source quinones are 5,8-dihydro-1,4-naphthoquinones having at least one hydrogen atom in each of the 5 and 8 ring positions. Other preferred incorporated hydrogen source quinones are those which have a hydrogen atom bonded to a carbon atom to which is also bonded the oxygen atom of an oxy substituent or a nitrogen atom of an amine substituted with the further provision that the carbon to hydrogen bond is the third or fourth bond removed from at least one quinone carbonyl double bond.

These photoreductants are further discussed in *Research Disclosure*, Vol. 126, October 1974, Publication No. 12617, Paragraphs II(A)-(B), of which Paragraph (B) has a specific listing of individual compounds to be used with a metal complex (MC). The entire discussion therein is expressly incorporated herein by reference.

The cobalt sulfide catalyst of layer 14*a* is imagewise formed in the manner disclosed in *Research Disclosure*, Vol. 130, February 1975, Publication No. 13023, Paragraphs VII(E) and (F), the details of which are expressly incorporated herein. That is, the photosensitive cobalt (III)complex intimately associated with the thioamide functional group in the photographic element, will upon exposure and preferably heating in portion 40*a* of layer 14*a*, FIG. 2*a*, form a cobalt sulfide image as suggested by the arrows linking the complex and the sulfide source. The image will either be latent or slightly visible, depending upon the exposure and heating conditions.

The cobalt sulfide thus imagewise formed acts as a catalyst when the element is contacted as shown in FIG. 2*b* with a developing mixture 30*a*. This mixture can include cobalt(III)complex represented by rectangles, or the complex can be supplied from excess, unreacted amounts in layer 14*a*. The mixture should include a conventional color developing agent represented by "+", of the type described above concerning the embodiment of FIG. 1. Again the cobalt complex can be selected from the identical class of complexes discussed above and may be the very same as, or different from, the individual cobalt(III)complex actually employed to imagewise form the cobalt sulfide. p The reaction between the color developing agent and the cobalt(III)-complex of the development mixture is essentially that described above for the previous embodiments, but here it produces a negative image. After the redox reaction is initiated by the CoS, the oxidized color-developing agent reacts with the color coupler in portion 40*a* only of the layer 14*a*, FIG. 2*b*, to form a dye image. The color of the image depends upon the coupler selected. The coupler can also be selected to form a diffusible dye, which is transferred to a suitable receiver sheet. An ammonia scavenger can be included when amines are the ligands of the complex and when considerable processing is contemplated. Representative scavengers are listed in *Research Disclosure*, Vol. 109, May 1973, Pub. 10911.

Thus, the overall reaction of the process is believed to be described by the following steps:

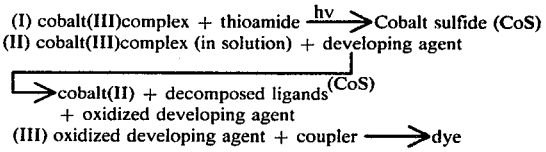

Reaction No. (I) of course occurs in the image-recording element upon exposure.

It is contemplated further that still other sulfide ion sources can be used, provided that a suitable solvent and a suitable binder or vehicle for the layer containing the source compound are selected. Included are, for example, α-mercapto carboxylic acids having the formula

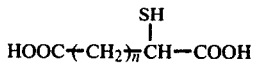

where n is 0, 1, 2 or 3, such as mercaptosuccinic acid; and aromatic mercaptothiazoles having the formula

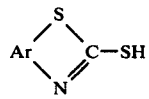

where Ar is an aryl radical having from 6 to 10 carbon atoms in the ring, such as 2-mercaptobenzothiazole.

Figure 3A:
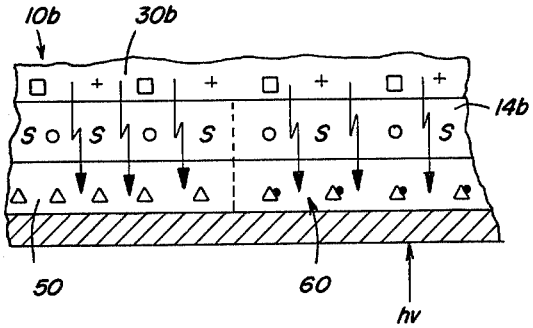
Figure 3B:
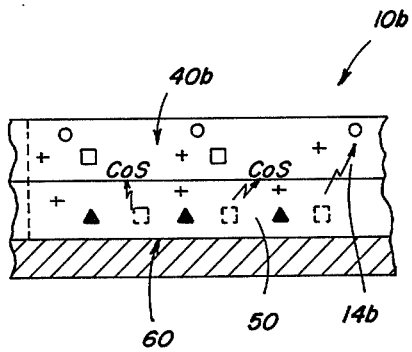

It is contemplated that the invention includes yet another embodiment wherein CoS is formed in situ in the image-forming layer, the image-providing element in this case including an image-forming layer coated over an intermediate catalytic layer as shown in FIGS. 3*a* and 3*b*. Parts similar to those previously described bear the same reference numeral to which the suffix "b" has been added. Thus, the image-forming layer 14*b* in element 10*b* has a source of sulfide ions represented by the letter "S", FIG. 3*a*, and a color coupler represented by the circles. The sulfide source and the coupler can be any one of the specific examples described above for the previous embodiments. However, no cobalt(III)complex is included. Instead the complex is introduced via the solution 30*b*. The intermediate layer 50 is provided with a catalyst, other than CoS, for initiating the redox reaction between the complex and a color developing agent also in solution 30*b*. As described in U.S. Pat. No. 3,862,842 issued to V. Bissonette on Jan. 28, 1975, a number of catalysts will cause this redox reaction. The discussion in this Bissonette patent concerning such catalysts is expressly incorporated herein by reference. One particularly useful catalyst is silver halide, as represented by the triangles, which can be appropriately spectrally sensitized by well-known techniques. Preferably, in such a case, a binder such as gelatin is also incorporated. Upon imagewise exposure to activating radiation, a latent silver image forms only in exposed portion 60, as shown by the symbols "Δ", FIG. 3*a*. When the processing solution 30*b* is added, both the cobalt(III)complex and the color developing agent, which can be exactly as described for the other embodiments, diffuse into both layers 14*b* and 50 as depicted by the wavy arrows. FIG. 3*b* illustrates the development of the silver halide into silver, which causes the redox reaction between the complex and the color developing agent in portion 60 of layer 50. The reduction of the complex, depicted by phantom rectangles, leads to the formation of Co(III), at least a part of which migrates as shown by the wavy arrows to portion 40*b* only of layer 14*b*, in which it reacts with the sulfide source to form CoS. This catalyst now leads to the redox reaction in layer 14*b*, between the complex, shown as rectangles , and the color developing agent, shown as + signs, which diffused into the layer in the first part of the processing. The oxidation of the color developing agent permits coupling with the coupler pre-incorporated into layer 14*b*.

The advantage of the aforedescribed embodiment is that it permits the use of a minimum of silver halide in layer 5, as the layer 14*b* is relied upon to provide the image formation, primarily. Typical amounts of silver halide which would be used are on the order of about 10 to 325 mg/m$^2$. Such reduction in the amount of silver present not only reduces the cost, it also can permit, in some uses, the elimination of a silver bleaching step.

In all of the above described embodiments, the image-forming layer can be formed on the support using any conventional coating technique. Typically, the reactants, the binder, and any desired addenda are dissolved in a solvent system and coated onto the support by such means as whirler coating, brushing, doctor blade coating, hopper coating and the like. Thereafter the solvent is evaporated. Other exemplary coating procecures are set forth in the *Product Licensing Index* publication cited above, at page 109. Coating aid can be incorporated into the coating composition to facilitate coating as disclosed on page 108 of the *Product Licensing Index* publication. It is also possible to incorporate antistatic layers and/or matting agents as disclosed on this page of the *Product Licensing Index* publication.

The solvent system can be a common solvent or a combination of miscible solvents which together bring all of the reactants into solution. Typical preferred solvents which can be used alone or in combination are water; lower alkanols, such as methanol, ethanol, isopropanol, t-butanol and the like, or other organic solvents particularly suited for the thioamide being used; and dibutyl phthalate or other solvents particularly useful with the coupler being used.

The binder for the image-forming layer can account for up to 99% by weight of the layer, but is typically employed in proportions of from 30 to 90% by weight of the radiation-sensitive layer. The surface or areal densities of the reactants can vary, depending upon the specific application. While the proportions of the non-binder reactats forming the image-forming layer can be varied widely, it is generally preferred for most efficient utilization for the reactants that they be present in roughly stoichiometric concentrations—that is, equal molar concentrations. One or more of these can, of course, be present in excess. Thus, in the embodiments shown in FIGS. 2*a* and 2*b*, it is useful to incorporate from 0.1 to 1.0 moles of the inert cobalt(III)complex per mole of the sulfur source. As noted above, for adequate catalytic effect, the sulfide source for that embodiment as well as the one shown in FIGS. 3*a* and 3*b* preferably is incorporated, expressed as moles of $S^{-2}$, in a concentration of at least $2.5\times10^{-5}$ moles per square decimeter and, most commonly, in a concentration of from $5.0\times10^{-5}$ to $5.0\times10^{-4}$ mols per square decimeter. The area densities of the remaining reactants are, of course, proportionate. With regard to the coupler, the molar relationship is conventional and is controlled by its interaction with the oxidized developing agent which in turn is dictated by the type of final dye desired. Typical amounts of coupler includes from about 270 miligrams per square meter to about 1075 milligrams per square meter.

Typically, the image-forming layer can vary widely in thickness depending on the characteristics desired for the image-recording element—e.g., image density, flexibility, transparency, etc. For most photographic applications coating thicknesss in the range of from 2 microns to 120 microns are preferred.

Although the above discussion is directed to an element adapted to provide a monochromatic image, it will be understood that the invention can also be utilized in a multi-colored element. This can be readily achieved by the provision of three separate but adjacent image-forming layers, each of which has dispersed in it a cobalt-sulfide precursor, in accordance with the invention, which is sensitized to the appropriate additive primaries. Thus, it is contemplated that the uppermost layer would be sensitized to green, as by the use of 3-carboxymethyl-5-[(3-ethyl-2-benzothiazolinylidene)ethylidene]rhodanine, and a magenta-dye forming coupler such as 1-(2,4,6-trichlorophenyl)-3-{5-[α-(3-tert-butyl-4-hydroxyphenoxy)tetradecanamido]-2-chloroanilino}-5-pyrazolone would be included. The layer next to the support would be sensitized to red, as by the use of hematoporphyrin, and a cyan-dye forming coupler such as a phenol would be incorpoated therein. The next color providing layer would be sensitized to blue, such as by the incorporation of 4[(3-ethyl-2-benxothiazolinyldene)-isopropylidene]-3-methyl-1-(p-sulfophenyl)-2-pyrazoline-5-one; and a yellow-dye forming coupler such as α-pivalyl-4-(4-benzyloxyphenylsulfonyl)phenoxy-2-chloro-5-[α-(2,4-di-tert-amylphenoxy)butyramido]acetanilide would be dispersed in this layer. Suitable barrier layers interposed between the layers would be utilized to prevent unwanted diffusion of exposure reaction products to the wrong color layer prior to development. In the embodiment of FIGS. 3*a* and 3*b*, each of the image-forming layers would be provided with its own intermediate silver halide layer, the spectral sensitizer in that case being in the silver halide layer rather than the image-forming layer. DIR couplers could be included to provide inter-image effects, as is well known.

EXAMPLES

By way of example only, the following are illustrative of the invention, and are by no means an exhaustive list of the permissible variations.

Example 1

The non-gelatin side of a photographic paper support having an optical brightener therein was coated at a thickness of 0.15 mm with a portion of Solution A and dried.

| Solution A | |
|---|---|
| Part I. coupler Dispersion | |
| 32 ml | 12½% gelatin solution |
| 1.5 g | 5-[α-(2,4-di-tert-amylphenoxy] hexamido-2-hepta-fluorobutyramidophenol |
| 3 ml | dibutyl phthalate |
| 3 ml | ethyl acetate |

This part was filtered and combined with a 17-ml aliquot of Part 2.

| Part II. | |
|---|---|
| 1.0 g. | hexa-amminecobalt(III) chloride in 10 ml water |
| 1.35 g | thiourea } in 8 ml water |
| 1.002 g | thioacetamide } in 8 ml water |
| 2.5 ml | Saponin (Spreading Agent) |

The film was exposed to a 1000-watt quartz iodine lamp held at a distance of 457 mm. A three-second exposure of the film, while being heated at 100° C., gave a sub-visible image. Treatment of the exposed film with Solution B for three minutes gave a visible cyan image.

| Solution B | |
|---|---|
| 1.0 g | tetrasodium ethylenediamine-tetraacetic acid as a cobalt(II) scavenger |
| 10.0 g | $Na_2SO_3$ } (antifoggant) |
| 1.0 g | NaBr } (antifoggant) |
| 30.0 g | $Na_2CO_3$ |
| 5.0 g | Benzyl Alcohol |
| 10.0 g | 4-amino-N-ethyl-N-β-hydroxyethyl-aniline sulfate |
| 1.6 g | hexa-ammine cobalt (III) chloride |

Add water to 1 liter and adjust pH to 10.8.

Example 2

Example No. 1 was repeated, except the exposure was conducted at 125° C. instead of 100° C. A visible cobalt sulfide image was produced before development.

Example 3

A polyethylene terephthalate transparent support was coated at a thickness of 0.3 mm with a portion of Solution C and air dried.

| Solution C | |
|---|---|
| 0.5 g | $[Co(NH_3)_6]Cl_3$ |
| 1.0 g | thiourea |
| 5 ml | water |
| 0.5 ml | N,N'-di[2-p-sodiosulfoanilino-4-diethanolamino-1,3,5-triazyinyl-(6)]-diaminostilbene-2,2'-disulfonic acid, sodium salt, as the spectral sensitizer |
| 2.5 ml | coupler dispersion as in Example 1 |
| Adjust pH to 8.0 with dilute NaOH | |

The coating was air dired and then overcoated with a hardened gelatin layer consisting of:

| | |
|---|---|
| 35 ml | 12 ½% gelatin |
| 2.5 ml | Saponin |
| 2.5 ml | 5% formaldehyde |

The film was exposed for one minute to a quartz iodine lamp. After exposure, the film was heated for ten seconds at 125° C. to yield some visible CoS image. The film was treated for one minute with prehardening solution and then washed for one minute. A five minute development in the redox-couple developer solution B described in Example 1 gave cyan dye in the area of the cobalt sulfide image.

Example 4

To illustrate one of the embodiments represented by FIG. 1, as disclosed in the aforesaid Maier application, black and white print paper having a conventional silver chloride emulsion was exposed for ¼ sec. to a 25 watt bulb through a letter chart and developed in Developer A below for 30 sec. A receiver sheet containing a uniform distribution of 250 mg gelatin/ft$^2$, 40 mg/ft$^2$ 1-(2,4,6-trichlorophenyl)-3-{5-[α-(3- tert-butyl-4-hydroxy phenoxy)tetradecanamido]-2l -chloroanilino}-5-pyrazolone and 0.9 mg CoS/ft$^2$ was briefly soaked in the above developed solution which had been adjusted to pH 5 with HCL and then to pH 4 with acetic acid. The developed paper was contacted with the wet receiver sheet for 30 seconds, the coatings were peeled apart, and the CoS coating was processed in developer B solution until a dye image formed. The coating was washed and dried.

Developer A: To approximately 500 ml of water was added:

3 gm. p-methylaminophenol sulfate
45 gm. sodium sulfite
12 gm. hydroquinone
80 gm. monohydrated sodium carbonate
2 gm. potassium bromide Volume was made up to 1.0 liter with water.

Developer B: To approximately 900 ml of water was added:

30 g $K_2CO_3$
2 g $K_2SO_3$
5 g 4-amino-N-ethyl-N(2-methoxyethyl)-m-toluidine di-p-toluene sulfonate
2 g $Co(NH_3)_6Cl_3$ The pH of Developer B was adjusted to 10.1 with 1 m/l HCl, and the volume was made up to 1.0 liter with water.

The invention has been described in detail with reference to certain preferred embodiments thereof, but it will be understood that variations and modifications can be effected within the spirit and scope of the invention.

What is claimed is:

1. A process for forming an image in an element having a support bearing a layer containing a cobalt sulfide precursor composition comprising a photoreducible inert cobalt(III) complex capable of forming cobalt sulfide in the presence of a source of sulfide ions, and a source of sulfide ions capable of combining with cobalt(II) to form cobalt sulfide;

the process comprising (a) imagewise exposing said layer;

(b) heating said layer, whereby the complex and the sulfide ion source combine to form a cobalt sulfide image, and (c) reacting a reducible cobalt(III) complex and a primary aromatic amine developing agent in the presence of the imagewise distributed cobalt sulfide and a color coupler, whereby the developing agent is oxidized and the oxidized developer reacts with the coupler to form a dye image.

2. The process as defined in claim 1 wherein the layer is heated during said heating step to at least about 125° C. to develop the cobalt sulfide to a visual image.

3. The process as defined in claim 1 wherein said coupler is incorporated within said layer prior to exposure.

4. The process as defined in claim 3 wherein said coupler is selected from the group consisting of naphthol and phenol color couplers.

* * * * *